US008539689B2

(12) United States Patent
Di Nicolantonio et al.

(10) Patent No.: US 8,539,689 B2
(45) Date of Patent: Sep. 24, 2013

(54) GUIDE RAIL FOR A HAND-HELD POWER TOOL

(75) Inventors: Aldo Di Nicolantonio, Recherswil (CH); Andre Hoffmann, Büren (DE)

(73) Assignee: Robert Bosch GmbH, Stuttgart (DE)

( * ) Notice: Subject to any disclaimer, the term of this patent is extended or adjusted under 35 U.S.C. 154(b) by 222 days.

(21) Appl. No.: 13/102,128

(22) Filed: May 6, 2011

(65) Prior Publication Data

US 2011/0271814 A1 Nov. 10, 2011

(30) Foreign Application Priority Data

May 7, 2010 (DE) ..... 10 2010 028 751

(51) Int. Cl.
*B43L 13/02* (2006.01)

(52) U.S. Cl.
USPC ..... 33/458; 33/418

(58) Field of Classification Search
USPC ..... 33/458, 613, 527, 526, 403, 404, 33/406, 407, 415, 418, 419, 422, 429, 452, 33/454, 456, 459, 460, 464, 468, 474, 476, 33/478, 479, 481
See application file for complete search history.

(56) References Cited

U.S. PATENT DOCUMENTS

| | | | | | |
|---|---|---|---|---|---|
| 1,489,239 | A * | 4/1924 | Eagan | 33/343 |
| 2,881,525 | A * | 4/1959 | Johnston | 33/466 |
| 2,945,301 | A * | 7/1960 | Peterson | 33/1 R |
| 3,913,440 | A * | 10/1975 | Baker | 83/745 |
| 4,019,256 | A * | 4/1977 | Johnson | 33/441 |
| 4,062,123 | A * | 12/1977 | Lundquist | 33/419 |
| 4,179,808 | A * | 12/1979 | Smith | 30/293 |
| 4,203,227 | A * | 5/1980 | Giroux | 33/458 |
| 5,103,566 | A * | 4/1992 | Stebe | 33/42 |
| 7,774,947 | B1 * | 8/2010 | Russo | 33/455 |

FOREIGN PATENT DOCUMENTS

DE 102004017420 11/2005

* cited by examiner

*Primary Examiner* — Yaritza Guadalupe-McCall
(74) *Attorney, Agent, or Firm* — Maginot, Moore & Beck

(57) ABSTRACT

A guide rail for a hand-held power tool includes at least two rail elements, which are to be joined together to form a common rail and which are held on one another by means of a releasable connecting device. The connecting device includes a joint device, by means of which the individual rails can be pivoted between a folded-together non-functioning position and a functioning position that lies in a common plane.

16 Claims, 5 Drawing Sheets

GUIDE RAIL FOR A HAND-HELD POWER TOOL

This application claims priority under 35 U.S.C. §119 to patent application no. DE 10 2010 028 751.2, filed May 7, 2010 in Germany, the disclosure of which is incorporated herein by reference in its entirety.

BACKGROUND

The present disclosure relates to a guide rail for a hand-held power tool.

Such a guide rail, which is designed to guide an electric hand-held tool such as, for example, a hand-held circular saw, router or compass saw onto the workpiece to be worked, is known from DE 10 2004 017 420 A1. The electric hand-held tool can be displaced along a guide groove in the guide rail, to enable a straight cut to be made. A slide block, which is connected to the hand-held power tool, slides in the guide groove of the guide rail.

To enable longer cuts to be made, the guide rail can be connected to an extension rail. For this purpose, the end face of the guide rail has a plurality of receiving openings, in which pegs that are disposed on the axial end face of the extension rail can be inserted.

Since the pegs on the end face of the extension rail can only be inserted in associated receiving openings, there is a risk, as a result of the working of the workpiece and the forces acting upon the rail during such working, of the connection between the guide rail and the extension rail becoming at least partially released and the extension rail becoming skewed relative to the guide rail and assuming an angle, which can negatively affect the work result.

A further disadvantage is the unergonomic handling of the guide rail and extension rail.

SUMMARY

The disclosure is based on the object of simplifying the handling of a guide rail for a hand-held power tool, which guide rail is composed of at least two individual rail elements. According to a further aspect of the disclosure, a clean cross section is to be ensured.

This object is achieved, according to the disclosure, by the features of set forth herein.

The guide rail according to the disclosure is used to guide a hand-held power tool, in particular an electric hand-held power tool such as, for example, a hand-held circular saw, a router or a compass saw, in order to ensure a straight cut in the workpiece to be worked during the sawing operation, by means of the hand-held power tool. The hand-held power tool is put onto the guide rail, which, for example, is provided with a guide groove, in which a slide block or the like of the hand-held power tool can be inserted in a sliding manner. The guide rail comprises at least two rail elements, which can be locked together by means of a releasable connecting device and can be joined to form a common rail. In the case of the guide rail according to the disclosure, the connecting device is realized as a joint device, which allows the individual rail elements to be pivoted between a folded-together, non-functioning position and a functioning position in which the individual rails, or rail elements, lie in a common plane. Preferably, the rail elements, when in the functioning position, extend along a common longitudinal axis, a functioning position in which the rail elements are disposed parallelwise in relation to one another also being possible in principle.

The joint device via which the rail elements are pivotally coupled to one another significantly improves the ergonomics, or handling, of the guide rail. When in the non-functioning position, the rail elements are folded together and, in particular, are in a position in which they lie on one another, such that the pack size in the folded-together state does not exceed the size of an individual rail in respect of the length and width, and is larger only in thickness. In the folded-out state, the rail elements are preferably pivoted by 180° relative to the non-functioning position, the pivoting motion between the non-functioning position and the functioning position being easily effected. In the non-functioning position with the rail elements lying on one another, the latter form a rail stack that is easily transported and stored, owing to the compact pack size. In the folded-out, functioning position, the rail elements assume the desired relative angle in relation to one another, owing to the kinematic coupling via the joint device. In particular, a coaxial alignment of the rail elements is achieved, such that the guide rail forms a rectilinear seating for guiding the hand-held power tool.

According to an expedient embodiment, a latching device is provided, by means of which the individual rails can be latched to one another, at least in the functioning position. In principle, however, it is also possible for the individual rails to be latched to one another also in the non-functioning position by means of the latching device, or a further latching device. In the functioning position, the latching device offers the advantage that inadvertent folding together by means of the joint device is prevented. Conversely, in the non-functioning position, inadvertent folding out of the rail elements is precluded because of the latching device.

The latching device is realized, for example, as a displaceable locking bar, which is preferably to be displaced in the axial direction along rail elements. In the latching position, the displaceable locking bar overlaps the end face of adjacent rail elements and thereby prevents the rail elements from being folded together. In order to achieve the non-functioning position, the locking bar must be displaced into its non-latching position, whereupon the rail elements can be folded about the pivot axis into the non-functioning position.

Embodiments in which the latching device is realized so as to be separate from the joint device and embodiments in which the latching device is a constituent part of the joint device are both possible. This is the case, for example, if the joint device comprises two slide strips and one intermediate joint unit that is pivotally connected to each slide strip, the slide strips being displaceably received in the rail elements. In this embodiment, the entire joint device is to be displaced along the rail elements, the joint device being displaced, for the purpose of changing over the rail elements between the non-functioning position and the functioning position, into a position in which the joint unit of the joint device is located between the rail elements. In order to achieve locking of the rail elements in the functioning position, on the other hand, the joint device is displaced axially to such an extent that the joint unit is located outside the end edge region between the two rail elements and, instead, the end edge region is overlapped by a slide strip of the joint device. Thus, at least one of the slide strips performs the function of a displaceable locking bar.

According to a further expedient embodiment, it is provided that the joint device comprises a respective hinge on each rail element, the hinges being able to be pivotally coupled to an intermediate joint piece. The hinges, which in the position of use are fixedly connected to the associated rail element, have, for example, a shaft receiver, in which a joint shaft on the joint piece can be inserted. The hinges are preferably composed of plastic, and can be inserted in end-face recesses in the individual rails. According to a further expedient embodiment, two shaft receivers, which are disposed with an axial offset, are provided on at least one hinge of the joint device, in which shaft receivers the joint shaft of a joint piece can be inserted, respectively, each of the shaft receivers expediently constituting a latching position. Depending on the position of the joint shaft in the one or other shaft receiver, the joint device has a differing length, the shorter length being assumed in the functioning position and the greater length serving to effect the adjustment between the functioning position and the non-functioning position, in order to have a sufficiently large motion space for the pivoting motion.

Even if the hinge is provided only with one shaft receiver for the joint shaft on the joint piece, the shaft receiver expediently constitutes a latching position. In order to obtain the required motion space for the pivoting motion, at least one hinge can be received, if necessary, so as to be also longitudinally displaceable on the rail element concerned.

In principle, any number of rail elements can be pivotally coupled together by means of joint devices and together constitute the guide rail. Thus, for example, it is possible for three or more rail elements to be respectively coupled to one another in a Z-shaped fold by means of end-face joint devices.

Further advantages and expedient embodiments are disclosed by the description and drawings below.

In the figures, components that are the same are denoted by the same references.

DETAILED DESCRIPTION

Figure 1:
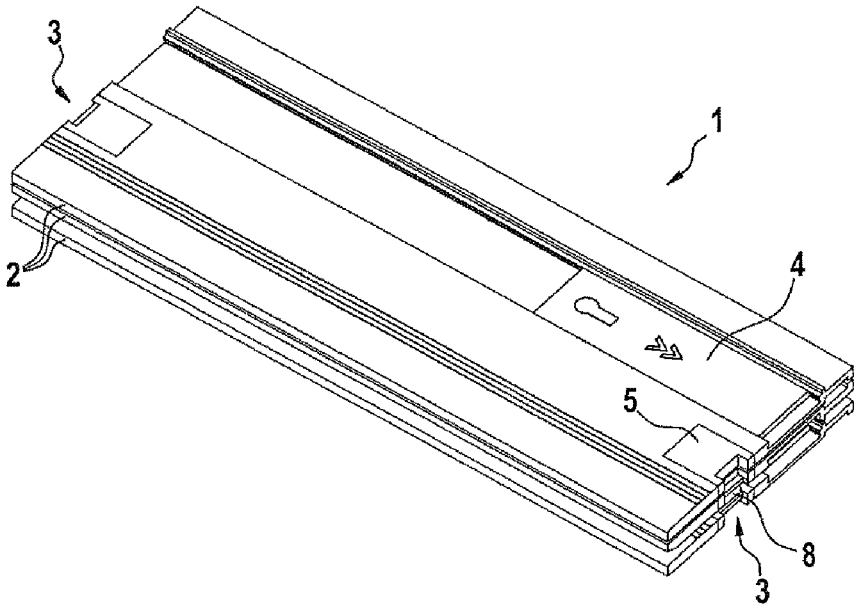
FIG. 1 shows a perspective view of a guide rail having a total of three guide elements, which are represented in a folded-together, non-functioning position, lying on one another, the rail elements being connected to one another in a jointed manner.
Figure 2:
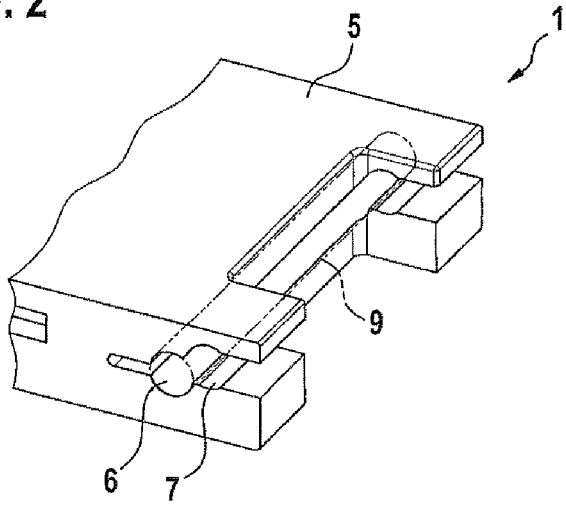
FIG. 2 shows a detail representation of a plastic hinge that can be inserted in a recess in a rail element and is a constituent part of a joint device between two rail elements.
Figure 3:
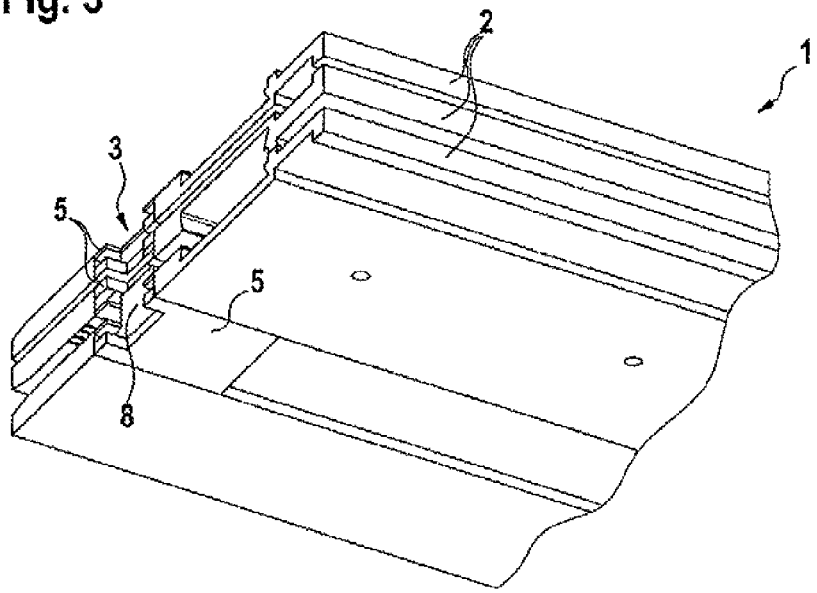
FIG. 3 shows a perspective view of the end face of the rail elements folded together to form a stack.

Represented in FIGS. 1 to 5 is a guide rail 1 consisting of three individual rail elements 2, which are each pivotally coupled to one another by means of end-face joint devices 3. In FIG. 1, the guide rail 1 is shown in the folded-together state, which constitutes the non-functioning position, and in which the individual rail elements 2 are stacked such that they lie directly on one another. The rail elements 2 are each identical to one another in their structure, and can be folded out, in a Z-shaped fold, between the non-functioning position represented in FIG. 1 and the functioning position shown in FIGS. 4 and 5, in which the rail elements 2 adjoin one another at the end faces and are aligned coaxially in relation to one another, such that a continuous seating surface is obtained for guiding a hand-held power tool. The reference 15 denotes the separation line between two rail elements 2 placed against one another without a gap.

Figure 4:
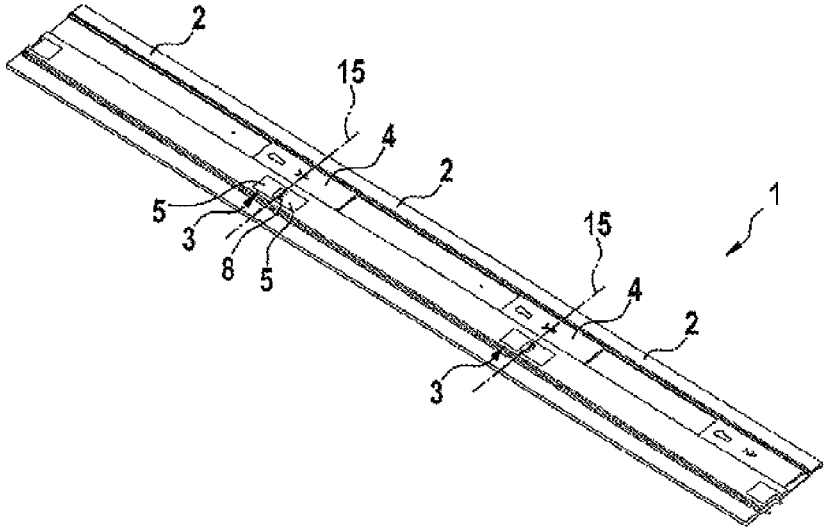
FIG. 4 shows the rail elements of the guide rail in the folded-out functioning position.
Figure 5:
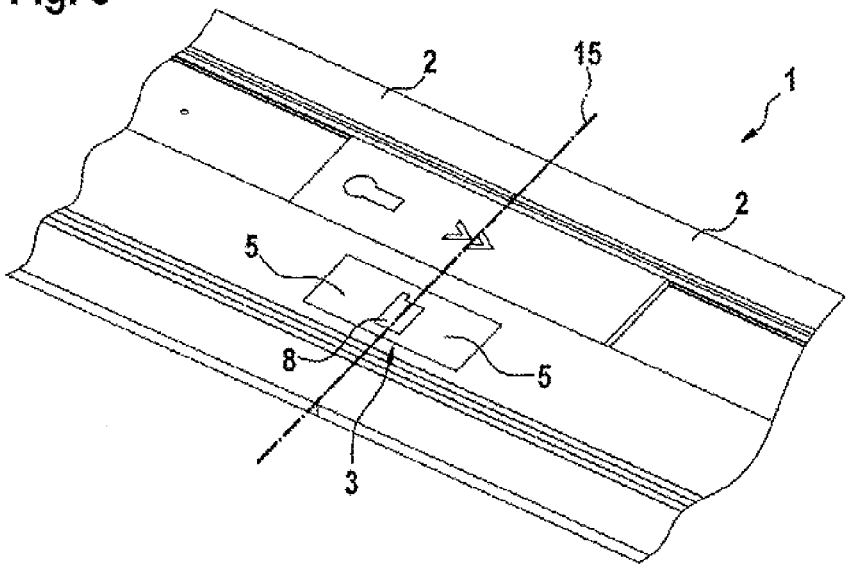
FIG. 5 shows an enlarged detail representation from the transition region between adjacent rail elements in the functioning position, having a displaceably disposed locking bar, which constitutes a latching device for locking the rail elements in the functioning position.

Each rail element 2 is provided with a locking bar 4, which is displaceably mounted on the top side of one of the rail elements, and which constitutes a latching device by means of which the rail elements are latched in the functioning position and secured against being inadvertently folded together. In the non-latching position according to FIG. 1, the locking bar 4 is in the retracted state, in which the locking bar 4 in its entirety is located on the top side of a rail element 2 and extends maximally only as far as the end edge of the rail element. By contrast, in the latching position, which is represented in FIGS. 4 and 5, the locking bar 4 overlaps the end edges of adjacent rail elements, which are combined to form the common guide rail and adjoin one another axially. Since only a pivoting or folding motion in one direction is possible, either because of kinematic limitations in the joint device 3 or on account of the end-face seating of adjacent rail elements, overlap of the locking bar 4 on only one side of the rail elements 2 suffices for securing against inadvertent folding together. For the changeover from the functioning position according to FIGS. 4 and 5 into the non-functioning position according to FIG. 1, the locking bar 4 must be pushed back, out of the position in which it overlaps the end edge, into the non-latching position, in which the locking bar is at a distance from the end edge. The locking bar 4 is disposed parallelwise in relation to the joint device 3, and is to be displaced along the top side of the rail elements 2, in the direction of the longitudinal axis of the guide rail.

The joint device 4 consists of two hinges 5, which are each realized as a plastic component and are fixedly inserted in an end-face recess in the rail elements 2. Furthermore, the joint device 3 comprises a joint piece 8, which, at opposing end faces, is provided with a respective joint shaft 9 that is pivotally received in a shaft receiver 6 or 7 realized in the hinge 5. In the joint device 3, therefore, there exists the possibility for pivoting about two axially offset, parallel joint shafts, which are realized on the joint piece 8. Each joint shaft 9 is received in a shaft receiver 6 or 7 in the hinge 5.

Each hinge 5 has two shaft receivers 6 and 7, which are adjacent but offset parallelwise in relation to one another with axial spacing, and which are each realized as latching recesses, such that the joint shaft 9 is in a latching position in each of the two shaft receivers 6 and 7, but can be turned in the shaft receiver. Owing to the axial offset between the shaft receivers 6 and 7—as viewed in the longitudinal direction of the rail elements—the total axial length of the joint device 3, consisting of two hinges 5 and the intermediate joint piece 8, can be set in a variable manner. If the joint shaft 9 is in the front shaft receiver 7 that faces towards the end face, the total axial length is greater than if the joint shaft 9 is positioned in the rear shaft receiver 6, which is at a greater distance from the end face. For the changeover motion between the non-functioning position and the functioning position, therefore, it is possible to bring the joint device into the position having a greater axial extent, such that there is more motion clearance available for the pivoting motion and blocking resulting from self-collision between the rail elements is precluded. In the non-functioning position according to FIG. 1, also, the joint device 3 assumes the axially lengthened position. To achieve the functioning position according to FIGS. 4 and 5, on the other hand, the joint device 3 is brought into the axially shortened position, in order to ensure that the end faces of adjacent rail elements 2 contact one another and that a continuous, gapless guide rail is formed.

Figure 6:
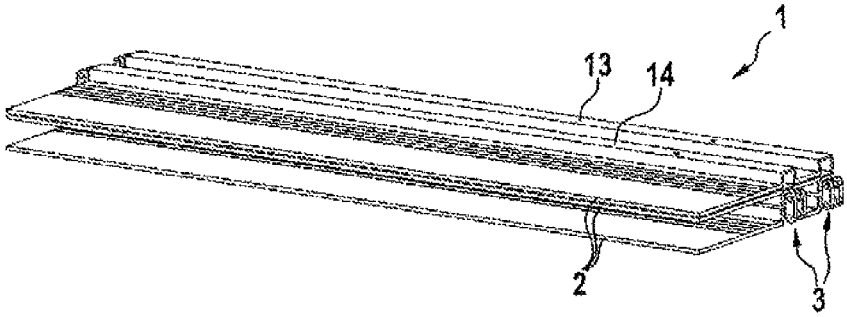
FIG. 6 shows, in a further embodiment, a guide rail having three rail elements in the non-functioning position, in which the joint device comprises two slide strips and an intermediate joint unit, the slide strips being displaceably received, respectively, in a rail element.
Figure 7:
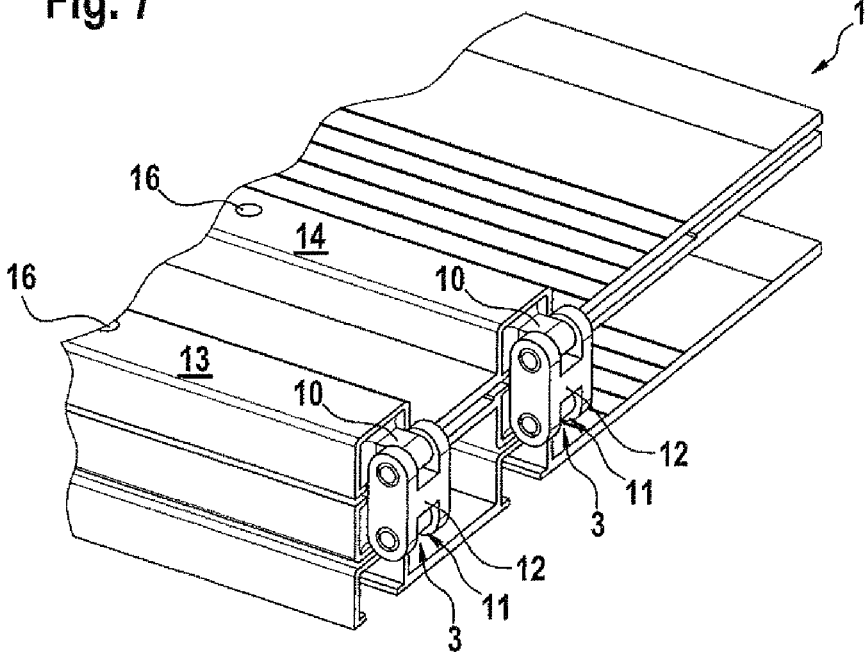
FIG. 7 shows an enlarged view of the joint device between the rail elements folded together in the non-functioning position.
Figure 8:
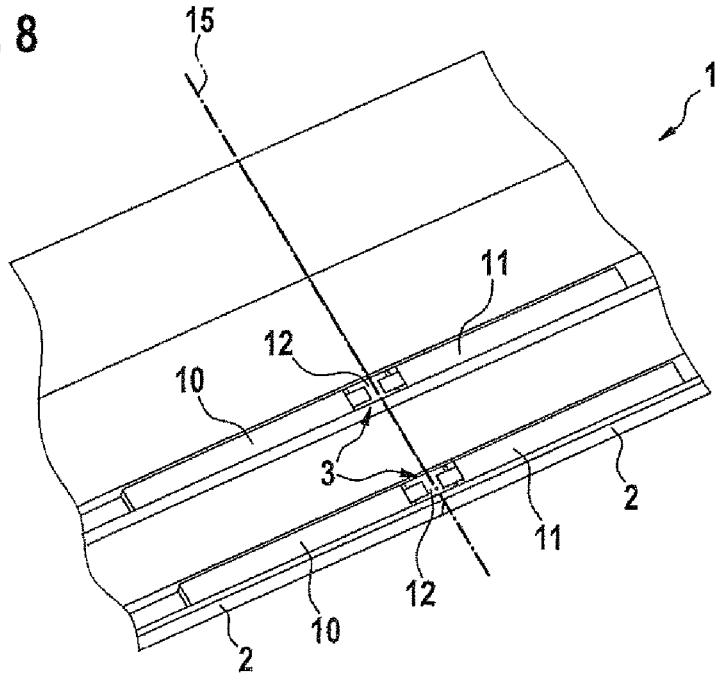
FIG. 8 shows a view of the underside of the guide rail, with the individual rail elements in the folded-out functioning position.
Figure 9:
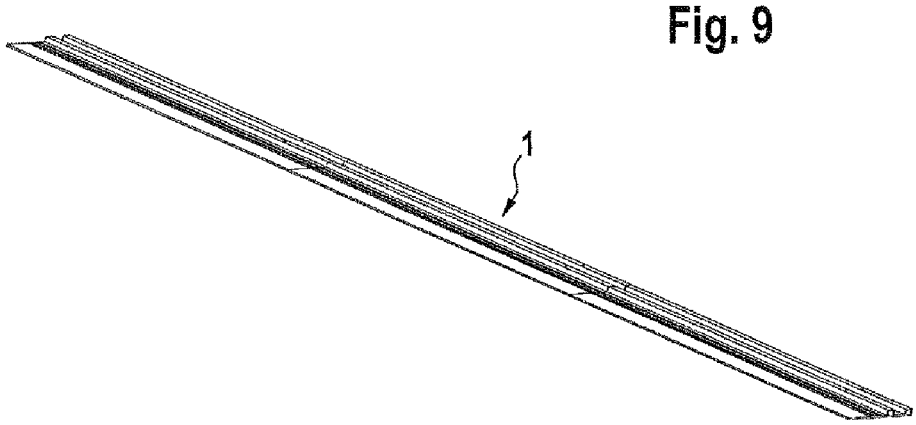
FIG. 9 shows a perspective representation of the guide rail in the functioning position.
Figure 10:
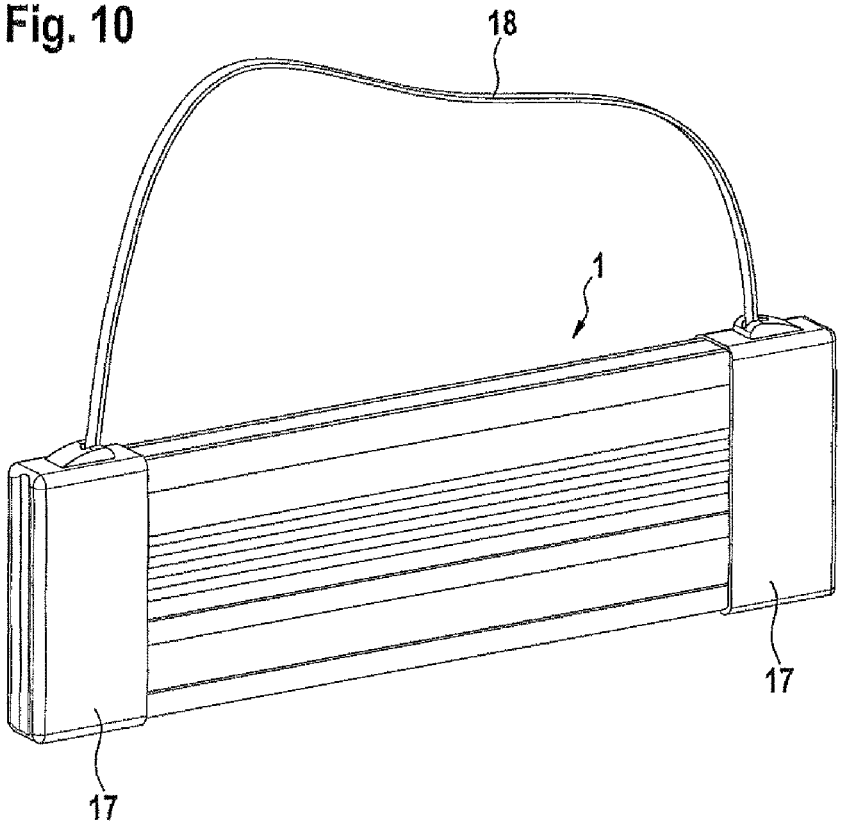
FIG. 10 shows the folded-together rail elements in the non-functioning position, with transport cap pieces fitted on the end faces and connected by a transport strap.

A further exemplary embodiment for a guide rail 1 is represented in FIGS. 6 to 10. The guide rail 1 comprises three individual rail elements 2, which are each pivotally coupled to one another in a Z-shaped fold by means of joint devices 3. In this case, in the non-functioning position, which is represented in FIGS. 6, 7 and 10, the joint devices 3 are located between, respectively, two directly adjacent rail elements 2 that are coupled together, on opposite sides of the rail stack.

The joint device 3 in the second exemplary embodiment differs from that of the first exemplary embodiment. As can be seen from FIGS. 7 and 8 in particular, the joint device 3 comprises two slide strips 10 and 11, which are each displaceably disposed in adjacent rail elements 2, and comprises an intermediate joint unit 12 that is coupled to each slide strip 10 and 11, respectively, in a jointed manner. Each of the slide strips 10, 11 is held so as to be displaceable in the axial direction of the rail elements 2. In the exemplary embodiment, guides 13 and 14 are provided for this purpose on the top side of the rail guide, which guides are realized so as to be integral with the guide rail, and extend in the direction of the longitudinal axis of each rail element.

In FIGS. 6, 7 and 10, the guide rail 1 is represented in the non-functioning position, with rail elements 2 lying over one another. FIGS. 8 and 9, by contrast, show the guide rail 1 in the folded-out functioning position, in which the individual rail elements 2 have been folded by 180° relative to the non-functioning position. As can be seen, in particular, from the view of the underside according to FIG. 8, immediately after folding out the joint unit 12 is located level with the separation line 15 between two adjacent rail elements 2 adjoining one another at the end faces. When the joint unit 12 is in this position, the rail elements 2 pivotally coupled by means of the joint device 3 can be pivoted into the folded-together position. If, on the other hand, the slide strips 10 and 11, including the joint unit 12 that is coupled to the rail strips in a jointed manner, is displaced in the direction of the longitudinal axis of the rail elements 2, the joint unit 12 comes into an axial position outside the separation line 15, and at the same time the separation line 15 denoting the meeting end faces of adjacent rail elements 2 is overlapped by one of the slide strips 10 or 11. The adjacent rail elements 2 that are coupled to one another by means of the joint device 3 are thereby latched by means of the joint device 3 and secured against a pivoting motion, such that the joint device 3 additionally assumes the function of a latching device.

In the exemplary embodiment, two joint devices 3, disposed next to one another, are provided to connect two adjacent rail elements 2.

As represented in FIG. 7, a latching element 16 is inserted in the guides 13 and 14, respectively, which latching element is to be brought into a latching position with a corresponding latching element on one of the slide strips 10 or 11, respectively. The non-functioning position represented in FIGS. 6, 7 and 10 thus also constitutes a latching position.

As can be seen from FIG. 10, for transport purposes the guide rail 1, with the rail elements lying on one another in the non-functioning position, can be provided with transport cap pieces 17, which can be placed on the end faces and connected via a transport strap 18. The rail elements 2 lying on one another are enclosed by the transport cap pieces 17 at the end faces.

What is claimed is:

1. A guide rail for a hand-held power tool comprising:

a first rail element including a first top face and a first bottom face;

a second rail element including a second top face and a second bottom face;

a releasable connecting device configured to join the first and second rail elements together, the releasable connecting device including a joint device so that the first and second rail elements are pivotable between (i) a folded-together non-functioning position in which the first top face of the first rail element is positioned over the second top face of the second rail element, and (ii) a functioning position in which the first top face of the first rail element and the second top face of the second rail element lie in a common plane; and a latching device movable with respect to the first and second rail elements between a first latching position and a second latching position, wherein, when the latching device is located in the first latching position, the first rail element is fixed in relation to the second rail element, and wherein, when the latching device is located in the second latching position, the first and second rail elements are movable between the folded-together non-functioning position and the functioning position.

2. The guide rail according to claim 1, wherein the latching device includes a displaceable locking bar positionable in (i) the first latching position to fix the first rail element in relation to the second rail element and (ii) the second latching position so that first and second rail elements are movable between the folded-together non-functioning position and the functioning position.

3. The guide rail according to claim 1, wherein the latching device is a constituent part of the joint device, the latching device being positionable in (i) the first latching position to fix the first rail element in relation to the second rail element and (ii) the second latching position so that first and second rail elements are movable between the folded-together non-functioning position and the functioning position.

4. The guide rail according to claim 1, wherein the joint device comprises two slide strips and an intermediate joint unit that is pivotally connected to the slide strips, the slide strips being displaceably received in the first and second rail elements.

5. The guide rail according to claim 1, wherein the joint device comprises a respective hinge on each rail element, the respective hinges being configured to be pivotally coupled to a joint piece.

6. The guide rail according to claim 5, wherein the respective hinges have a shaft receiver for a joint shaft on the joint piece.

7. The guide rail according to claim 5, wherein the respective hinges are components that are separate from the first and second rail elements and are inserted in end-face recesses defined in the rail elements.

8. The guide rail according to claim 5, wherein at least one hinge of the joint device has two shaft receivers configured with an offset.

9. The guide rail according to claim 5, wherein the joint piece has a joint shaft at respective ends thereof.

10. The guide rail according to claim 9, wherein the respective hinges have a shaft receiver configured to receive one of the joint shafts of the joint piece.

11. The guide rail according to claim 10, wherein the joint device is configured to be adjustable in length.

12. The guide rail according to claim 11, wherein at least one hinge of the joint device has two shaft receivers configured with an offset.

13. The guide rail according to claim 12, wherein the length of the joint device is adjustable between (i) a non-functioning length defined when the joint shaft of the joint device is positioned in the shaft receiver nearest the end face of the hinge and (ii) a functioning length defined when the joint shaft of the joint device is positioned in the shaft receiver farthest from the end face of the hinge, the non-functioning length being greater than the functioning length.

14. The guide rail according to claim 13, wherein the joint device is in its non-functioning length when the first and second rail elements are in the folded-together non-functioning position and the joint device is in its functioning length when the first and second rail elements are in the functioning position.

15. The guide rail according to claim 1, wherein the joint device is configured to be adjustable in length.

16. The guide rail according to claim 1, wherein:

the first rail element defines a first guide groove, the second rail element defines a second guide groove, when the first and second rail elements are positioned in the folded-together non-functioning position, the first guide groove is positioned over the second guide groove, and when the first and second rail elements are positioned in the functioning position, the first guide grove is aligned with the second guide groove.

* * * * *

UNITED STATES PATENT AND TRADEMARK OFFICE

CERTIFICATE OF CORRECTION

PATENT NO. : 8,539,689 B2
APPLICATION NO. : 13/102128
DATED : September 24, 2013
INVENTOR(S) : Di Nicolantonio et al.

It is certified that error appears in the above-identified patent and that said Letters Patent is hereby corrected as shown below:

In the claims:

Claim 16, line 8 (col. 8, line 15): Please replace "the first guide grove is aligned" with -- the first guide groove is aligned --.

Signed and Sealed this
Fifteenth Day of July, 2014

Michelle K. Lee

Michelle K. Lee
*Deputy Director of the United States Patent and Trademark Office*